US007389824B2

(12) United States Patent
Jackson

(10) Patent No.: US 7,389,824 B2
(45) Date of Patent: Jun. 24, 2008

(54) FIRE EXTINGUISHING SYSTEM

(75) Inventor: Eldon D Jackson, Hastings, MI (US)

(73) Assignee: The Viking Corporation, Hastings, MI (US)

( * ) Notice: Subject to any disclaimer, the term of this patent is extended or adjusted under 35 U.S.C. 154(b) by 148 days.

(21) Appl. No.: 11/387,607

(22) Filed: Mar. 23, 2006

(65) Prior Publication Data

US 2006/0243459 A1 Nov. 2, 2006

Related U.S. Application Data

(63) Continuation-in-part of application No. 10/935,255, filed on Sep. 7, 2004.

(60) Provisional application No. 60/500,434, filed on Sep. 5, 2003.

(51) Int. Cl.
*A62C 35/00* (2006.01)

(52) U.S. Cl. ..... 169/16; 169/19; 169/37; 169/54; 169/61; 239/69; 239/303; 239/565; 137/79

(58) Field of Classification Search ..... 169/5, 169/8, 14, 15, 16, 19, 20, 37, 54, 56, 60, 169/61; 239/303–305, 67, 69, 565; 137/79, 137/460, 266, 565.33
See application file for complete search history.

(56) References Cited

U.S. PATENT DOCUMENTS 3,702,636 A * 11/1972 Hart ..... 169/54
4,326,589 A * 4/1982 Ballman ..... 169/5
4,361,189 A * 11/1982 Adams ..... 169/14
6,263,974 B1 * 7/2001 Sundholm ..... 169/54
6,367,560 B1 * 4/2002 de Ris et al. ..... 169/16
6,491,109 B2 * 12/2002 Christenson et al. ..... 169/16

* cited by examiner

*Primary Examiner*—Steven J Ganey
(74) *Attorney, Agent, or Firm*—Harness, Dickey & Pierce, P.L.C.

(57) ABSTRACT

An early suppression fast response fire protection system includes a sprinkler piping system with at least one sprinkler head assembly, a water supply system, and a check valve in fluid communication with the sprinkler piping system and the water supply system. An antifreeze solution supply system is in fluid communication with the sprinkler piping system, with the check valve isolating the antifreeze solution from the water supply unless a fire condition occurs. A control is provided that is in communication with a flow detector, which detects the pressure of the antifreeze solution in the sprinkler piping system, and a pressure detector, which detects the flow of water through the check valve, and controls the flow of the antifreeze solution to the sprinkler piping system and maintains the pressure of the antifreeze solution in the sprinkler piping system unless the flow detector detects the flow of water through the check valve in which case the control stops the flow of antifreeze solution to the sprinkler piping system to limit the discharge of antifreeze solution from the fire protection system.

28 Claims, 8 Drawing Sheets

FIRE EXTINGUISHING SYSTEM

This application is a continuation-in-part application from U.S. application entitled PREACTION FIRE EXTINGUISHING SYSTEM FOR ESFR COLD STORAGE APPLICATIONS, Ser. No. 10/935,255, filed Sep. 7, 2004, which claims priority from U.S. provisional application Ser. No. 60/500,434, filed Sep. 5, 2003, entitled PREACTION FIRE EXTINGUISHGING SYSTEM FOR ESFR COLD STORAGE APPLICATIONS, which are both incorporated herein in their entireties.

TECHNICAL FIELD AND BACKGROUND OF THE INVENTION

The present invention generally relates to fire protection systems and, more particularly, to fire protection systems that have a particularly useful application in unheated environments subject to cold or freezing temperatures, such as cold or refrigerated storage environments; though it should be understood that the concepts of this invention have much broader application and are, therefore, not limited to unheated environments.

SUMMARY

The present invention provides an early suppression fast response (ESFR) preaction system, which uses a fire suppression solution, such as water, foam or, in a cold environment application, an antifreeze solution, such as a propylene glycol antifreeze or potassium lactate, as a supervising medium in the sprinkler piping system of the area being protected. Further, the sprinkler piping system includes one or more air vents to vent the system when the sprinkler system piping is being filled with the fire suppression solution to minimize, if not eliminate compressible gas in the system. The protection system may include a control system with a detection system to provide a single interlock system to control the opening of a control or deluge valve, which may be used to control the delivery of supply water to the sprinkler piping system, and only opens the valve when the detection system detects a fire condition. If a fire is detected by the detection system, the deluge valve will open prior to sprinklers opening and will pressurize system for extinguishing of fire.

In the case of a cold environment application, use of the antifreeze solution as a supervisory medium of the sprinkler piping integrity in combination with a detection system prior to operation of the preaction deluge or flow control valve will prevent costly contamination of antifreeze solution with water if a false situation of fire or a broken sprinkler occurs. This system can be applied using looped, gridded or tree type piping systems, though a tree type piping layout provides the fastest response.

Further, in the event of a fire, the control system will stop the flow of antifreeze solution pre-charging the sprinkler system to limit the amount of the antifreeze solution discharged from the sprinkler system in the event of a fire and in the event of a break in the sprinkler piping system so that essentially only a limited amount of the solution will be discharged.

Also included in the preaction system of the present invention may be the single or double-interlock features described in the copending application Ser. No. 10/438,726, filed May 15, 2003, assigned to The Viking Corporation of Hastings, Mich., (which is incorporated by reference herein in its entirety), which operates from auxiliary power if available or from pneumatic or hydraulic operation if power is lost.

In contrast to current cold application wet pipe antifreeze type systems, where antifreeze solution is pumped into the piping system and separated from the water supply using a check valve arrangement and pressurized at a higher pressure than the water supply, the preaction system of the present invention uses a control valve to holds back the high-pressure water supply so that the pressure in the sprinkler piping system containing antifreeze solution may be maintained at a much lower pressure and supervised for integrity of the piping system using pressure switches. As noted, the preaction deluge or control valve holds back the water supply until the detection system detects a fire condition, in which case water is then released by the deluge valve and supplied to the sprinkler system. The sprinklers are all closed and only those in the area of the fire are open due to heat applied to the fusible link of each sprinkler.

With the ESFR preaction cold storage system of the present invention it is possible to break up the system into smaller tree-type systems that allow isolation of the area of operation. Further, with tree-type configurations, the system is easier to set up for drainage. Also with a center feed main line supplying branch lines, the flow is directed to the first open sprinkler, which allows the antifreeze solution to be expelled and replaced with plain water much faster than grid type systems.

In one form of the invention, an early suppression fast response fire protection system includes a sprinkler piping system with at least one sprinkler head assembly, a water supply system, and a check valve. The outlet of the check valve is in fluid communication with the sprinkler piping system. The inlet of the check valve is in selective fluid communication with the water supply system. The system also includes a fire suppression solution supply system, which is in fluid communication with the sprinkler piping system. The check valve isolates the fire suppression solution from the water supply unless a fire condition occurs. Also provided are a pressure detector, which detects the pressure of the fire suppression solution in the sprinkler piping system, a flow detector, which detects the flow of water from the water supply system, and a control system, which is in communication with the flow detector and the pressure detector. The control system controls the flow of the fire suppression solution to the sprinkler piping system and maintains the pressure of the fire suppression solution in the sprinkler piping system unless the flow detector detects the flow of water from the water supply system in which case the control system stops the flow of fire suppression solution to the sprinkler piping system to limit the discharge of fire suppression solution from the fire protection system.

In one aspect, the sprinkler piping system includes one or more vents, such as automatic vents, that vent gas from the sprinkler piping system when the sprinkler piping system is filled with the fire suppression solution to reduce, if not eliminate, any compressible gas that may occur in the sprinkler piping system.

In another aspect, the sprinkler piping system comprises a tree-shaped piping system with a main pipe and branch pipes extending from the main pipe. For example, the main pipe may comprise a center main pipe. In yet a further aspect, each of the branch pipes includes a vent.

In another aspect, the fire protection system includes a control valve with an inlet in fluid communication with the water supply system. The control valve outlet is in fluid communication with the check valve wherein the check valve is in selective fluid communication with the water supply system through the control valve. Additionally, the fire protection system may include at least one fire detector, with the control system in communication with the fire detector and the control valve, with the control system actuating the control valve to open in response to the detector detecting a fire condition, but maintains the control valve closed in a non-fire condition.

In a further aspect, the control valve is in fluid communication with the check valve through a conduit, with the conduit filled with air. In addition, the fire protection system may include an air pressure monitoring system that monitors the air pressure in the conduit, with the control system in communication with the air pressure monitoring system. In this application, the control system may open the control valve only when the detection system detects a fire condition. Optionally, the control system may open the control valve only when the detection system detects a fire condition and the air pressure monitoring system indicates a pressure drop to provide a double-interlock system. Though it should be understood that is some systems this may not be preferable.

In a cold environment application where the sprinkler system piping is filled with antifreeze solution, the fire protection system may also include a second check valve, with the first check valve located between the second check valve and the control valve. The second check valve moderates the thermal transfer from the antifreeze in the sprinkler piping system to the first check valve, which reduces the frost on the water supply side of the fire protection system.

According to yet another aspect, the fire protection system may optionally include an automatic pressure control system that relieves pressure in the sprinkler piping system when the pressure in the sprinkler piping system exceeds the desired pressure for the system. The automatic pressure control system may include, for example, a pressure switch at the first check valve that detects the pressure at the outlet of the first check valve and a release valve, such as an electrical operated solenoid valve, that allows fire suppression solution to be either returned to the antifreeze supply system or to a storage tank.

In another aspect, the sprinkler piping systems comprises a tree-shaped configuration with a center or side feed main line and at least two branch lines extending from the main line. Further, each branch line may include an automatic vent to vent gas from the system, for example when the sprinkler piping system is being filled with the antifreeze solution.

In one aspect, the sprinkler piping system includes a plurality of sprinkler head assemblies, each having a K-factor in a range of 11 to 50. Further, each of the sprinkler head assemblies may comprise a pendent or an upright sprinkler.

According to yet another aspect, the system further includes a second sprinkler piping system with at least one sprinkler head assembly and a second check valve with an outlet in fluid communication with the second sprinkler piping system and an inlet in fluid communication with the water supply system through a second control valve. The fire suppression solution supply system is in fluid communication with the second sprinkler piping system, with the second check valve of the second sprinkler piping system isolating the fire suppression solution in the second sprinkler piping system from the water supply unless a fire condition occurs. A second pressure detector, which detects the pressure of the fire suppression solution in the second sprinkler piping system, and a second flow detector, which detects the flow of water through the second check valve when the second check valve is opened are also provided. The control system, which is in communication with the second flow detector and the second pressure detector, controls the flow of fires suppression system to the second piping sprinkler and maintains the pressure of the fire suppression solution in the second sprinkler piping system unless the second flow detector detects the flow of water through the second check valve in which case the control system stops the flow of fire suppression solution to the second sprinkler piping system to limit the discharge of fire suppression solution from the fire protection system.

In another form of the invention, an early suppression fast response fire protection system includes a water supply system and a check valve for each sprinkler piping system. Each check valve has an inlet and an outlet, with each of the outlets of the check valves in fluid communication with a respective sprinkler piping system, and each of the inlets in fluid communication with the water supply system. The fire protection system further includes a fire suppressant solution supply system in fluid communication with each of the sprinkler piping systems. Each of the check valves isolates the fire suppression solution in the respective sprinkler piping system from the water supply unless a fire condition occurs. Also provided are pressure detectors for detecting the pressure of the fire suppression solution in each of the sprinkler piping systems and flow detectors associated with each of the sprinkler piping systems. The flow detectors detect the flow of water from the water supply to each of the sprinkler piping systems. Additionally, the fire protection system includes a controller in communication with the flow detectors and the pressure detectors, which controls the flow of fire suppression solution to each of the sprinkler piping systems and maintains the pressure of the fire suppression solution in each of the sprinkler piping systems unless a flow detector associated with a respective sprinkler piping system detects the flow of water from the water supply system to the respective sprinkler piping system in which case the controller stops the flow of fire suppression solution to the respective sprinkler piping system to limit discharge of fire suppression solution from the fire protection system.

In a cold environment application, the fire suppression solution comprises antifreeze. In non-cold environment applications, the fire suppression solution may comprise a foam/water mixture or water, for example.

In one aspect, a control valve is provided for each sprinkler piping system. Each control valve is in fluid communication with the water supply system and in fluid communication with the check valve of a respective sprinkler piping system. In a further aspect, the system further included at least one fire detector associated with each of the sprinkler piping systems. The control valves control the flow of water from the water supply to the check valves. The controller opens a respective control valve to open the flow from the water supply to the check valve of a respective sprinkler piping system associated with the fire detector that detects a fire. For example, the control valve may comprise a preaction deluge valve.

In other aspects, each of the sprinkler piping systems comprises a tree-shaped configuration with a main line and a plurality of branch pipes extending from the main line. Further, at least one branch pipe of each sprinkler piping system includes a vent to vent gas from its respective sprinkler piping system. For example, the vents may comprise automatic vents.

According to another aspect, where the system is used in a cold storage application and the fire suppression solution comprises an antifreeze solution, each sprinkler piping system includes a second check valve, which reduces thermal transfer from the antifreeze solution to the primary check valves.

In another aspect, the sprinkler head assemblies of each sprinkler piping system each has a K-factor in a range of 11 to 50. The sprinkler head assemblies may comprise a pendent or upright sprinklers.

Further, each sprinkler piping system may include an automatic pressure control system. The automatic pressure control systems automatically relieves pressure in a respective sprinkler piping system when the pressure of the fire suppression solution in the respective sprinkler piping system exceeds a maximum pressure, but maintain the pressure above the minimum set point for the first check valves to maintain the first check valves closed.

According to another form, a cold storage fire suppression system includes a sprinkler piping system, a water supply system, a check valve, and a deluge valve in selective fluid communication with the check valve. The deluge valve controls the flow of water to the sprinkler piping system from the water supply system through the check valve. The fire protection system further includes at least one fire detector associated with the sprinkler piping system for detecting a fire condition and an antifreeze solution supply system in fluid communication with the sprinkler piping system. The check valve isolates the antifreeze solution from the water supply system and the deluge valve unless a fire condition occurs, in which case the deluge valve is opened. The fire protection system also includes a pressure detector that detects the pressure of the antifreeze solution in the sprinkler piping system and a control system that monitors the pressure detector. The control system controls the supply of the antifreeze solution to the sprinkler piping system and maintains the pressure of the antifreeze solution in the sprinkler piping system. In addition, the control system is in communication with the fire detector and the deluge valve. The control system actuates the deluge valve to open in response to the fire detector detecting a fire condition and stops the flow of antifreeze solution to the sprinkler piping system to limit the discharge of antifreeze solution from the fire protection system when the control system detects flow of water through the deluge valve.

In one aspect, the fire protection system further includes a second check valve, which reduces the thermal transfer from the antifreeze solution in the sprinkler system piping to the first primary check valve. In a further aspect, the sprinkler piping system includes a tree-shaped configuration with a main pipe and a plurality of branch pipes extending from the main pipe. Each of the branch pipes has a plurality of sprinkler head assemblies and, further, a vent to vent gas from the sprinkler piping system when being filled with the antifreeze solution. In further aspect, the control system further includes an automatic pressure control system that releases the pressure of the antifreeze solution in the sprinkler piping system when the pressure exceeds the maximum pressure of the sprinkler piping system but maintains the pressure above the minimum set point pressure of the first check valve.

In yet another form of the invention, a method of delivering fire suppressant to an area includes providing a water supply, providing a sprinkler piping system in the area to be protected that is in selective fluid communication with the water supply, pre-charging the sprinkler piping system with a fire suppression solution, and monitoring the pressure of the fire suppression solution in the sprinkler system piping. Further, the pressure of the fire suppression solution in the sprinkler piping system is maintained at a desired pressure. In addition, a detector is provided in the vicinity of the sprinkler piping system, which is monitored. The fire suppression solution is isolated from the water supply system until the detector detects a fire and upon the detector detecting a fire, the water is allowed to flow from the water supply system to the sprinkler piping system but the flow of the fire suppression solution to the sprinkler piping system is stopped.

In one aspect, gas is vented from the sprinkler piping system when the sprinkler piping system is pre-charged with the fire suppression solution.

In another aspect, the fire suppression solution is isolated from the water supply by a check valve. Further, the pressure of the fire suppression solution is monitored for over pressurization and the pressure of the fire suppression solution is released when the pressure exceeds a maximum pressure for the sprinkler piping system, but maintained to maintain the pressure above the minimum set point pressure of the check valve. Where the sprinkler piping system is provided in a cold area, the sprinkler piping system is pre-charged with antifreeze solution.

As would be understood, the present fire protection system provides a preaction early suppression fast response system that is particularly suitable for use in a cold environment and provides enhanced control of the fire suppression solution. These and other objects, advantages, purposes, and features of the invention will become more apparent from the study of the following description taken in conjunction with the drawings.

DETAILED DESCRIPTION OF THE PREFERRED EMBODIMENTS

Figure 1:
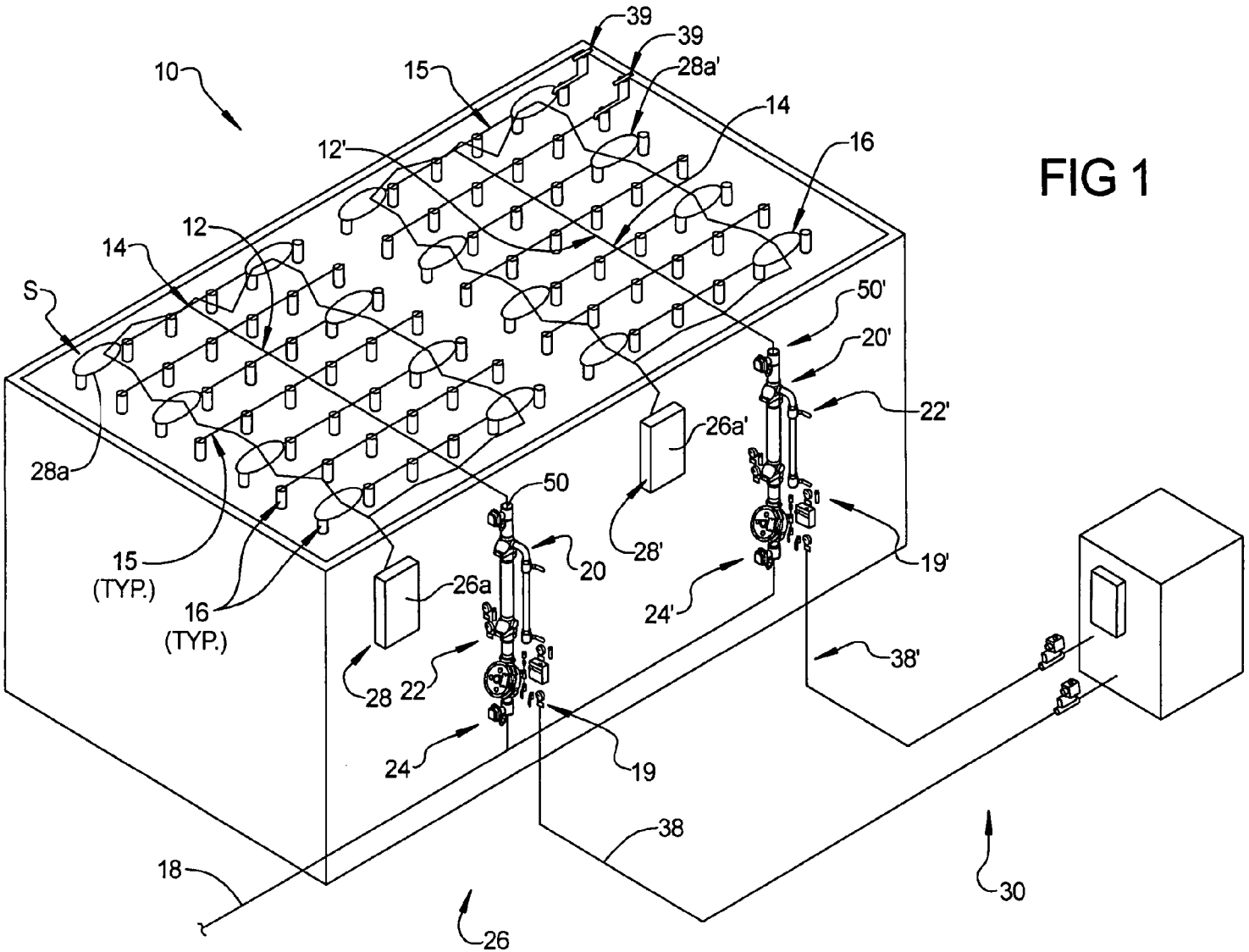
FIG. 1 is a schematic piping drawing of an early suppression fast response (ESFR) fire protection system of the present invention that is suitable for unheated storage application, incorporating a sprinkler piping system in a tree configuration.

Referring to FIG. 1, the numeral 10 generally designates an early suppression fast response (ESFR) fire protection system of the present invention that is particularly suitable for unheated environments subject to cold or freezing conditions, including freezer or cold storage applications. Though the invention is not so limited and instead has broad application to where a pre-charged preaction early suppression fast response (ESFR) fire protection system is suitable. In addition, system 10 is preferably pre-primed or pre-charged with a fire suppression solution and may be configured as a single interlock system or a double interlock system depending on its application. As will be more fully described below, system 10 may include two or more sprinkler piping systems 12, 12' that are selectively filled with plain water from a water supply 18 in the event of a fire condition but pre-charged during a non-fire condition with a fire suppression solution, such as an antifreeze and water solution for a cold environment, or foam/water solution or water in a non-cold environment where cold temperatures or freezing is not an issue. The fire suppression solution is maintained at a desired pressure in the sprinkler piping system by a fire suppression solution supply system, described more fully below. Further, system 10 is optionally and preferably configured to reduce frost build-up on the water supply side of the system when the system is used in a cold environment. Additionally, system 10 is configured so that when the sprinkler's piping systems are pre-charged with the fire suppression solution, the compressible gas in the sprinkler piping systems will be significantly reduced, if not eliminated. Another feature that may be included is an automatic pressure control system that maintains the pressure of the fire suppression solution between the maximum desired pressure of the sprinkler piping system and a minimum desired pressure.

In the illustrated embodiment, system 10 includes two sets of sprinkler piping systems 12, 12', which are arranged in a tree-shaped piping configuration, each with a central main pipe 14 and a plurality of branch lines or pipes 15. Branch lines 15 each include a plurality of sprinkler head assemblies 16, which comprise closed heat sensitive pendent or upright sprinklers with a K-factor at a range of 11 to 50 and with an ordinary temperature reading or rating in a range of 155° F. to 286° F., and optionally, with a K-factor in a range of 11-50 and more typically of about 25 and a temperature rating of about 165° F. Suitable sprinkler head assemblies include Viking ESFR K25.2 VK510 pendent sprinklers having an ordinary temperature rating of 165° F. Though, as noted above, the sprinkler assemblies may be pendent or upright. As will be more fully described below, the number of sprinkler piping systems may be increased or decreased as needed depending on the size of the area to be protected.

As noted in the illustrated embodiment, area S comprises a cold storage area that is subject to cold or freezing temperatures. Area S is protected by two sets of sprinkler piping systems 12, 12', which are in fluid communication with water supply system 18 through risers 19, 19', which include check valves 20, 22 and 20', 22' and control valves 24, 24'. Piping systems 12 and 12' are isolated from each other by their respective check valves 20, 22, and 20', 22' and control valves 24 and 24', which reduces the area covered by each of the respective sprinkler piping systems and hence the volume of each sprinkler piping system. By reducing the area covered, this reduces the amount of antifreeze solution that is released when the overall system is actuated. Further, with a center feed main pipe supplying the branch lines, the flow of antifreeze solution is directed to the first open sprinkler head assembly when the system is triggered to allow the antifreeze solution to be expelled from the branch lines and the main line leading directly to the open sprinkler head assembly, which results in the water being replaced in the system much faster than, for example, in a conventional grid type system. Therefore, by segregating areas of area S into discrete areas, with each area having one sprinkler piping system, the responsiveness of each sprinkler piping system is increased. Further, as will be understood, with a tree-type piping configuration, the system is easier to set up for drainage. Although illustrated with a center feed line or pipe, side or end feed pipes, or offset feed pipes may also be used.

In this cold storage application, the fire suppression solution that is used to pre-charge the sprinkler system is an antifreeze and water solution. Suitable antifreeze solutions include a propylene glycol antifreeze or potassium lactate or an antifreeze of food grade solution in combination with wetting agent, which provides extinguishing characteristics similar or better than water. The use of propylene glycol, water and wetting agent or Class A foam solutions may be used and may be used in combination, which provides an extinguishing solution that will not freeze under normal conditions. As would be understood, the solution mixture is determined by lowest temperature of protected area.

Preferably, sprinkler piping system 12 is pitched for drainage of the system after operation. For refrigerated area systems, piping system 12 is preferably pitched to drain the system toward the riser and valve 20. For example, branch lines may be pitched at ½" per 10 ft. (4 mm/m), with the main lines pitched at ½" per 10 ft. (4 mm/m) run of pipe. For systems in unheated areas subject to freezing, branch lines may be pitched at ½" per 10 ft. (4 mm/m), with the main lines pitched at ¼" per 10 ft. (2 mm/m) run of pipe. As noted above, the present system may be used in non-cold environments; however, for ease of description, reference hereinafter will be made to a cold storage application where an antifreeze solution is used.

In addition, as will be more fully described below, the sprinkler piping systems are pre-charged in a manner to significantly reduce, if not eliminate, compressed gas (such as air) from the systems when setting the supervisory pressure from the antifreeze supply system, which results in further increased responsiveness of the sprinkler piping systems. For ease of description, hereinafter, the operation of the individual sprinkler piping systems will be made in reference to sprinkler piping system 12 and valves 20, 22, and 24; though it should be understood that the same description applies to sprinkler piping system 12' and valves 20', 22', and 24'.

As best seen in FIG. 1, sprinkler piping system 12 is in a refrigerated or cold storage area S, with central main pipe 14 extending into area S on one end and exiting storage area S at its other end for connection to a water supply line 18 through check valves 20 and 22 and a control valve 24, which are arranged on a riser 19 that is located outside of the storage area S. Control valve 24 and the fire suppression supply system, which in the illustrated embodiment is an antifreeze supply system 30, are controlled by a control system 26, which includes a detection system 28 (28') for each sprinkler piping system. The detection system is preferably capable of operation prior to or equal to an ESFR Sprinkler having an RTI (Response Time Index) of 50 or less.

Control system 26 includes a control panel **26*a* (26*a*' for system 12'), which is in communication with the fire detectors 28*a* (28*a*' for system 12') of detection system 28 (28' for system 12') located in storage area S. Referring again to just system 12, control panel 26*a*** is preferably a listed releasing panel capable of single hazard and two-zone operation. The control panel may be provided with a back-up battery supply, typically a 90-hour backup battery supply. The first zone shall operate the releasing circuit and alarm. The second shall detect low pressure antifreeze and provide alarm.

Preferably, each sprinkler piping system (12, 12') has one or more fire detectors **28*a* (28*a*') associated therewith so that the control valves may be independently opened and, further, opened when the fire detectors associated with a sprinkler piping system are actuated. Therefore, if the fire detectors of more than one sprinkler piping system are actuated, the respective control panel 26*a* (26*a*'**) will open the control valves associated with each sprinkler piping system that has an actuated fire detector. In this manner, water is not delivered to the respective check valves until a fire condition associated with the respective sprinkler piping system is detected, which minimizes the risk of water damage in a non-fire condition.

In the illustrated embodiment, control valve 24 may comprise preaction deluge valve similar to the valve described in reference to co-pending application entitled FIRE PROTECTION SYSTEM, Ser. No. 10/438,726, filed May 15, 2003, which is commonly assigned to The Viking Corporation of Hastings, Mich. which is incorporated by reference herein in its entirety. For example, the piping between check valve 22 and valve 24 may be supervised by air, preferably a low-pressure air. Control panel 26*a* may be configured to open the control valve when a fire detector of a sprinkler piping system detects a fire to provide single interlock system or to open the control valve when a fire detector of a sprinkler piping system detects a fire and a supervisory pressure switch detects a pressure drop for that same sprinkler piping system to provide a double interlock system. Further, as described in the referenced application, control panel 26*a* may be configured so that during a normal powered state, the control valves will only be opened when both conditions noted above occur but in a loss-of-AC power condition, control panel 26*a* may be configured to open the respective control valves when a fire is detected by the fire detectors of that sprinkler piping system.

Check valve 22 is configured to isolate the antifreeze and water solution mixture from the water supply until such a time that a fire is detected in the storage area S. As noted above, sprinkler piping system 12 is arranged in a tree-shaped configuration with a plurality of branch lines 15 extending from central main pipe 14, with each of the branch lines 15 having a plurality of sprinkler head assemblies 16. The antifreeze solution is isolated from the supply water by check valve 22 and also from control valve 24 until a fire condition exists. A suitable check valve for valve 22 includes Easy Riser™ check valve Viking Model F-1, from The Viking Corporation, which includes a system main drain 22*c*, inlet connection 22*d* (FIGS. 3 and 4) for antifreeze supply system 30, supply system pressure switch 30*a*, supply system supervisory switch 30*b* and supply gauges 30*c* to monitor system antifreeze pressure and control antifreeze supply system 30. Valve 22 is located downstream of the valve 24, for example within a range of 1 to 2 ft. Valve inlet 22*a* of valve 22, which is in selective fluid communication with valve 24, is atmospheric air, while outlet 22*b* will be the desired static antifreeze pressure to the sprinkler piping system. Options for the check valve include a pressure relief valve 43 (FIG. 4) and an automatic pressure control system 38*a* (FIG. 5) for variable temperature freezers and coolers described more fully below.

Figure 4:
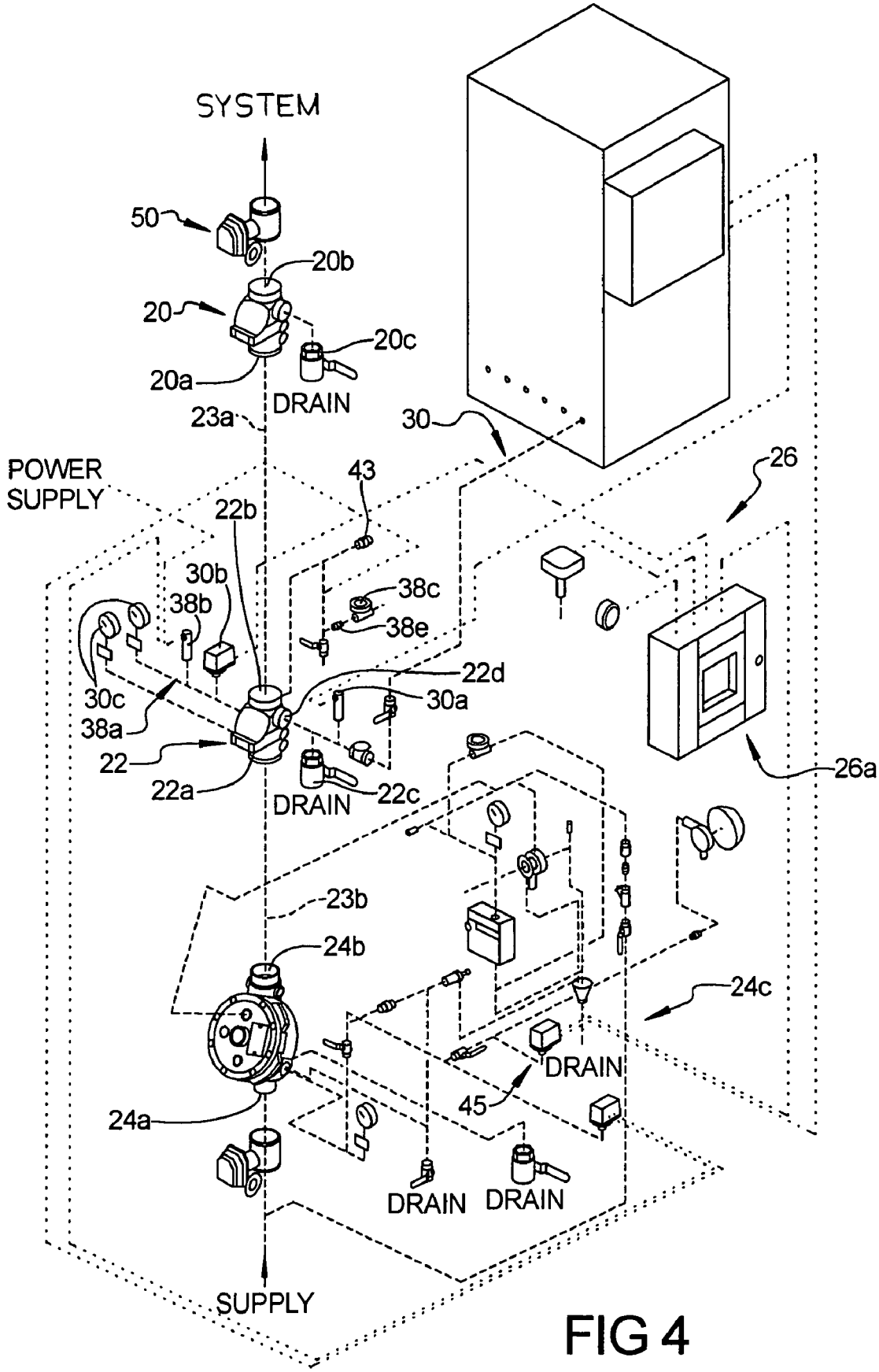
FIG. 4 is an exploded view of the components of the water supply side.

A suitable control valve for valve 24 includes a standard Viking Model E-1 or F-1 deluge valve including conventional deluge trim with electric release 24*c* (FIG. 4). Valve 24 controls the supply water to the sprinkler piping system and has a static supply pressure capable of supplying adequate starting pressure of the most remote sprinklers. The operation of the control valve is caused by the operation of detection system 28 after sensing a fire condition. Further, control valve 24 is configured to initiate an alarm during a sustained flow of water (such as the flow required by an open sprinkler) by operating an optional water monitor alarm and alarm pressure switch (45).

Figure 2:
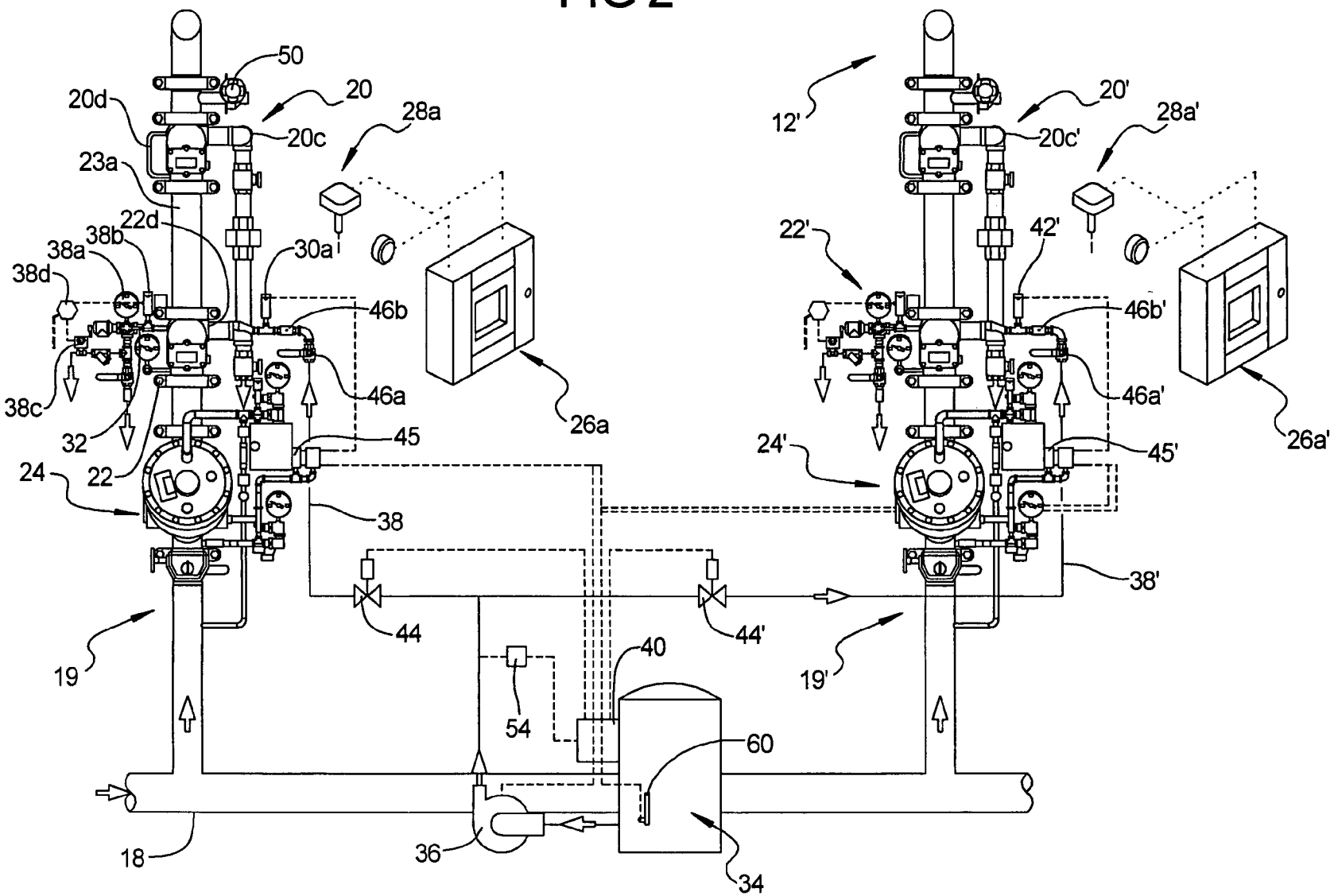
FIG. 2 is a piping and control schematic of the water supply side and antifreeze supply side of the system of FIG. 1.
Figure 3:
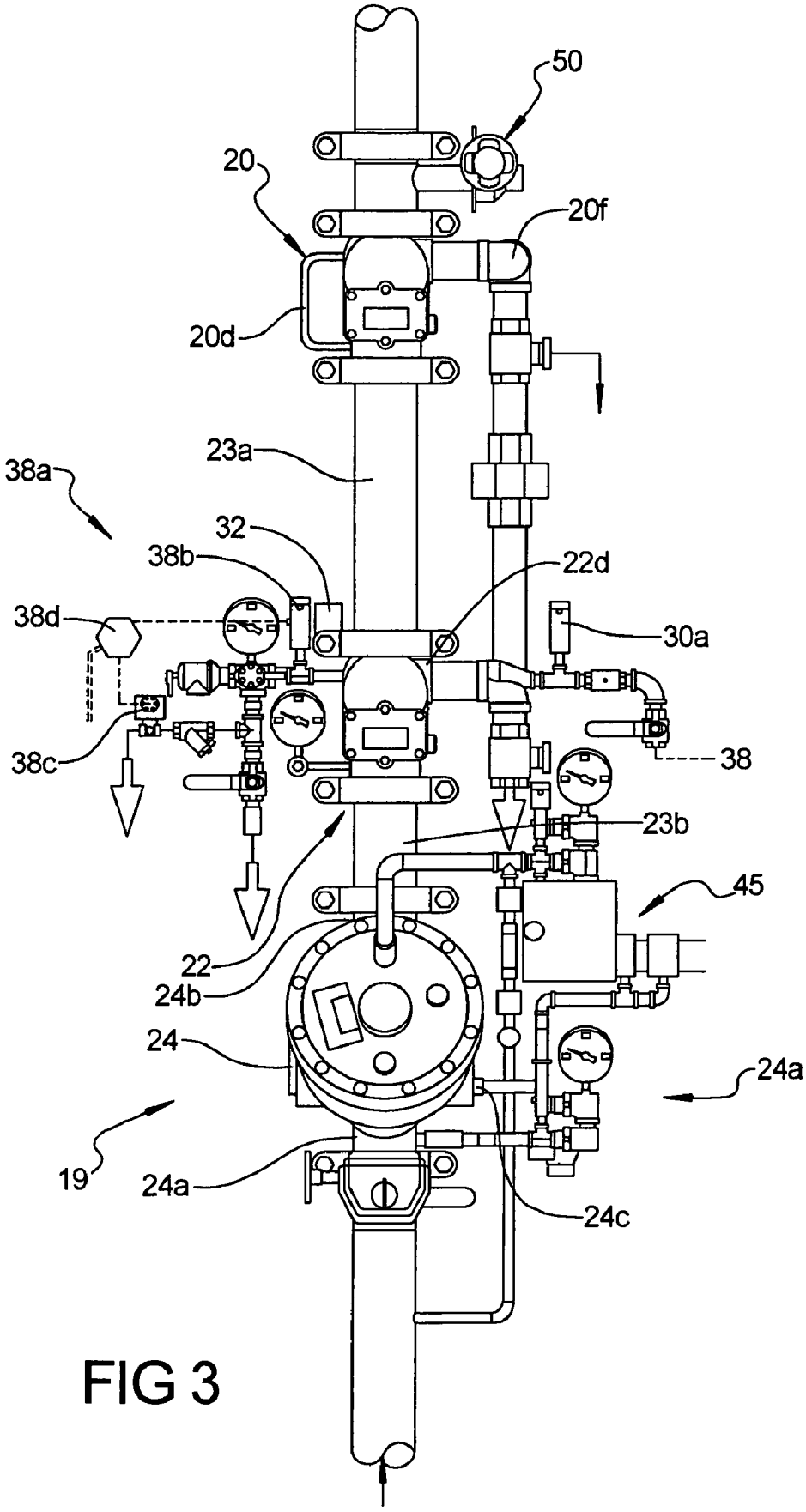
FIG. 3 is an enlarged view of the control valve and check valves of the system of FIG. 1.

As best seen in FIGS. 2 and 3, check valve 20 is installed above check valve 22. Valve 20 protects riser 19 and the clapper of check valve 22 from thermal transfer from the cold antifreeze in the freezer area, which minimizes frost on the riser and on the control valve assembly. For example, valve 20 is preferably installed at least five feet above or downstream from check valve 22 and installed as close to the cold storage area wall as possible. Further, check valve 20 includes a system main drain 20*c* and a by-pass line 20*d* (FIG. 4), which allows for proper system pressure monitoring and allows all system controls on the check valve 22 to function properly. The drain line 20*c* is optionally piped to the main drain (22*c*) of the primary check valve 22, which is then optionally returned to a recovery tank described more fully below. Valve 20, therefore, helps to minimize insulation and heat trace requirements to the riser system outside of the freezer. A suitable check valve for valve 20 also includes Viking Model F-1, Easy-Riser™ check valve.

As best understood from FIGS. 3 and 4, check valve 20 includes an inlet 20*a*, which is in fluid communication with the outlet 22*b* of check valve 22 through a conduit 23*a*, and an outlet 20*b* which is in fluid communication with sprinkler piping system 12 through an isolation valve 50. Similarly, inlet 22*a* of valve 22 is in fluid communication with the outlet 24*b* of control valve 24 through a conduit 23*b*. The antifreeze and water mixture, which fills piping system 12, is pressurized by antifreeze supply system 30, which maintains the clapper of check valve 22 in a closed positioned against the seat of the valve until a fire condition occurs. During a sustained flow of water, such as the flow that results from an open sprinkler, the pressure in the antifreeze solution drops below the check valve set point pressure so that the clapper moves off the seat of check valve 22 to its open position to allow the water supply to flow from valve 24 through the check valve 22 and into the sprinkler piping system 12. Valve 24 also includes an alarm port such that when water flows through the open valve and enters the alarm port, alarm pressure switch device 45 will be activated to shut-off the supply of antifreeze solution to the sprinkler piping system described more fully below.

Inlet 24*a* of control valve 24 is in communication with water supply piping 18 and, further, is controlled by control system 26, which may provide pneumatic or electric control of control valve 24 and includes detection system 28. In the illustrated embodiment, the piping below check valve 22 and above outlet 24*b* of valve 24 is at atmosphere or low pressure and, as will be more fully described below, may be supervised by control system 26.

The antifreeze and water solution (hereinafter referred to as antifreeze solution) is delivered to piping system 12 through antifreeze solution supply system 30, which is used to maintain the antifreeze solution in the sprinkler piping system 12 (as well as additional systems) at pressures greater than the set point or trip pressure of valve 22 (and also the respective valves of each system). Referring to FIG. 2, system 30 includes pressure switch 54, which senses the pump discharge pressure and turns on pump 36 when the unit pressure drops to a preset value and then stops the pump when the pressure rises to a higher preset value. Level switch 60, which is mounted to the storage tank, opens when the premix liquid level is low. When level switch 60 opens, pump 36 is stopped until the tank is filled and switch 60 is reset. System 30 delivers the antifreeze solution to piping system 12 through a second inlet 22*d* of check valve 22 and is designed to maintain supervisory system static pressure in the sprinkler piping using the antifreeze solution.

Referring again to FIG. 2, antifreeze supply system 30 includes a tank 34 and pump 36 that automatically maintains the antifreeze solution pressure in piping system 12 above the set point pressure value of check valve 22 until a sprinkler is activated. Tank 34 is preferably an atmospheric storage tank and has an adequate capacity for the largest system volume installed. The tank may also be used as a reclaim tank for the antifreeze solution in the system piping when the system(s) is drained for system service and for discharge of antifreeze solution if system pressure exceeds 175 PSI (1 207 kPa) at the sprinklers, as more fully described below.

The purpose of pump 36 is to lock in a supervisory pressure in the sprinkler piping system and eliminate air for proper performance of the system. Pump 36 provides a static pressure on the antifreeze solution in the sprinkler piping system by taking suction from tank 34, which is an atmospheric storage tank with the antifreeze solution, and discharging to the downstream or system side of the clapper of check valve 22.

The antifreeze solution pressure, for example, may be maintained at a minimum of 50 PSI (345 kPa). This maintenance pressure is applied by the pump in order to eliminate air pockets and prevent water from migrating into the system antifreeze solution in the event of an accidental operation of the deluge valve. This is why it is preferable to eliminate most, if not all, air from the system. If a gas, such as air is present, it can compress to allow water into the system, reducing the desired percentage (concentration) of, for example, propylene glycol in the solution, thus increasing the risk of localized freezing. Also by eliminating air pockets, the life of the antifreeze solution may be extended, and possible corrosion of system piping may be reduced.

As best seen in FIG. 3, a supervisory pressure switch 32 is located on the system side of check valve 22 or directly adjacent to the system inlet that monitors the antifreeze solution pressure and signals pump 36 to maintain pressure in the proper range. Pump 36 may provide, for example, a 5 GPM (18,9 1/min) flow at a minimum of 50 PSI (345 kPa) pressure. Supervisory pressure switch 32 may be included in the check valve 22 trim.

Tank 34 holds a premix of antifreeze solution, for example a premix of propylene glycol and water in a range of 20% to 65% premix of propylene glycol/water solution and optionally in a range of 35% to 50% premix of propylene glycol/water solution. As noted above, the antifreeze solution is used to precharge the sprinkler piping system and control the fire, followed with plain water to suppress the fire. For example, where the minimum temperature in the area being protected is 8° F. (−13.3° C.) or above, 35% percent premix of propylene glycol/water may be preferable. Where the minimum temperature in the area being protected is between 8° F. (−13.3° C.) and −21° F. (−29.4° C.), the percentage by volume of propylene glycol to water is preferably 50%. The propylene glycol/water mixture cools and adds wetting ability to control the fire until the water is supplied to suppress the fire. Tank 34 is optionally equipped with a fluid level indicator, and the internal low fluid level indicator switch 60 noted above that shuts off the pump and gives a supervisory alarm of low fluid level. The tank is also preferably fitted with a pressure/vacuum vent valve.

As noted above, the antifreeze solution is pumped from tank 34 by pressure pump 36, which delivers the antifreeze solution to inlet 22*d* of check valve 22 through conduit 38. Preferably, when filling the piping system with antifreeze solution, all air is bled from the system in order to maintain the antifreeze solution pressure non-compressible. The system may be filled with pump 36 or may be filled using a portable pump, which may provide a faster fill. In order to bleed the sprinkler piping system 12 of gas, such as air, system 12 includes one or more vents 39 (FIG. 1), such as automatic air vent assemblies. Suitable automatic vent assemblies are available under Model AV-1 from The Viking Corporation of Hastings, Mich. Preferably, a vent is provided at the end of each branch line (15) and, further, at any high points in the main line (14). Vents 39 are set to automatically vent air during filling of system 12 and, further, break the vacuum for faster drainage of the system when performing maintenance or draining the system after operation.

Figure 6A:
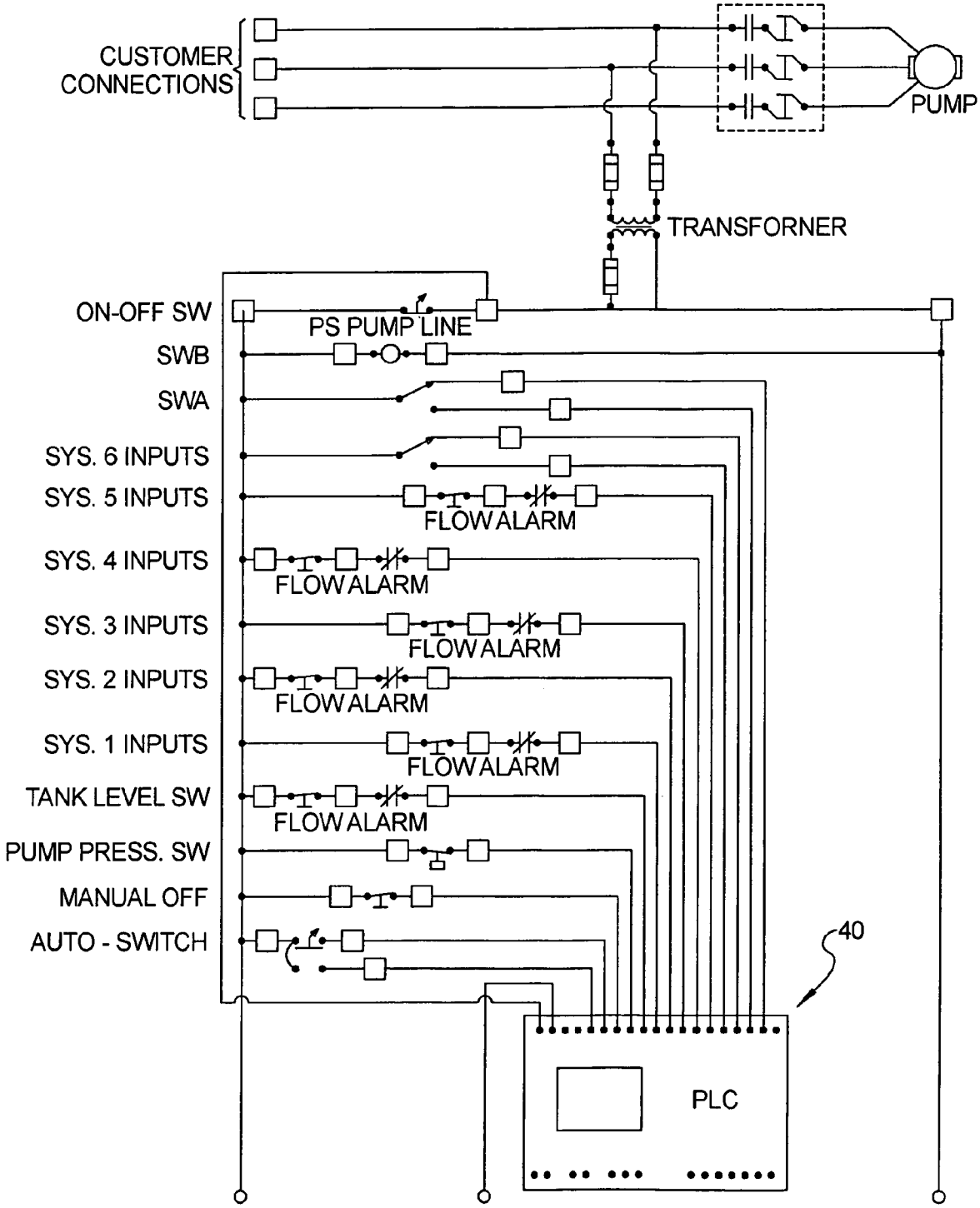
FIGS. 6A-6C are schematic views of the control panel and electrical system for the antifreeze supply system for a multiple sprinkler piping system.
Figure 6B:
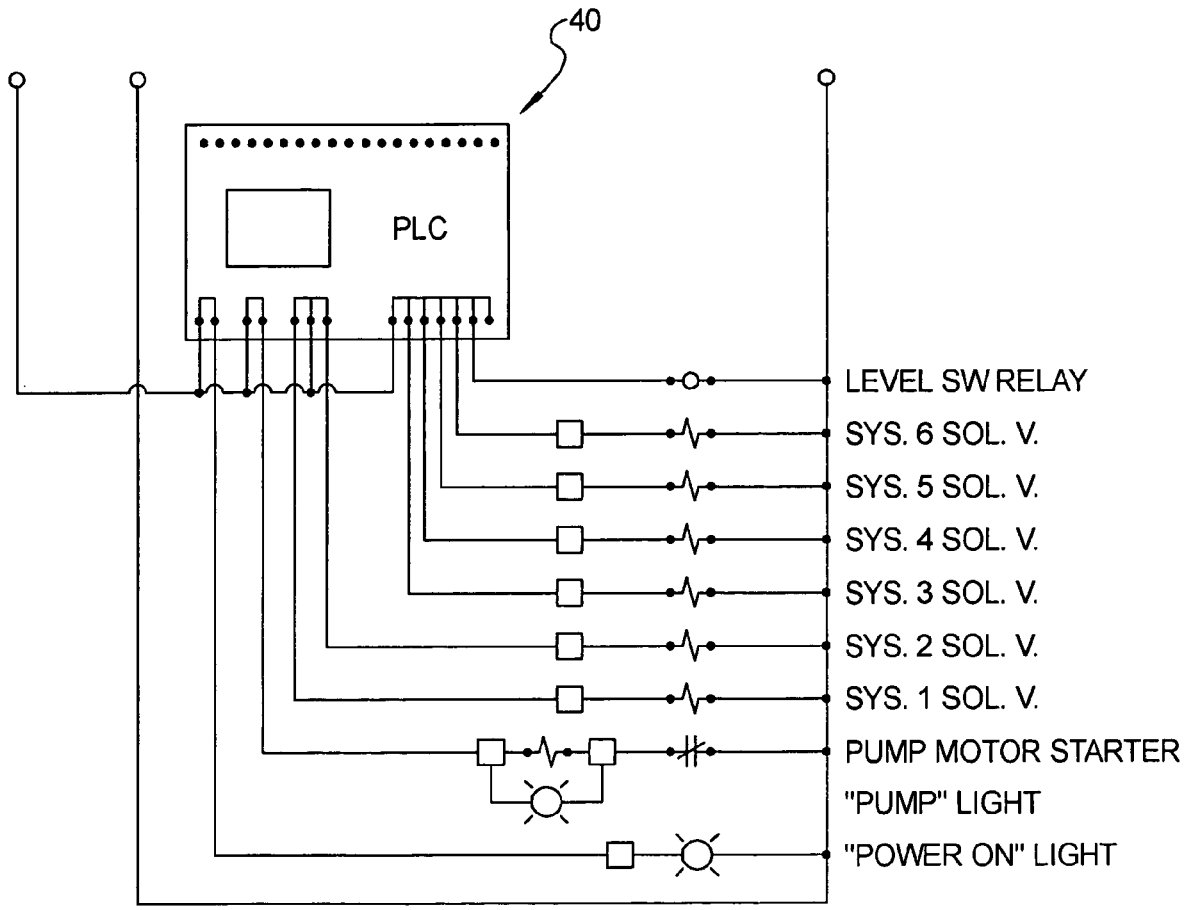
Figure 6C:
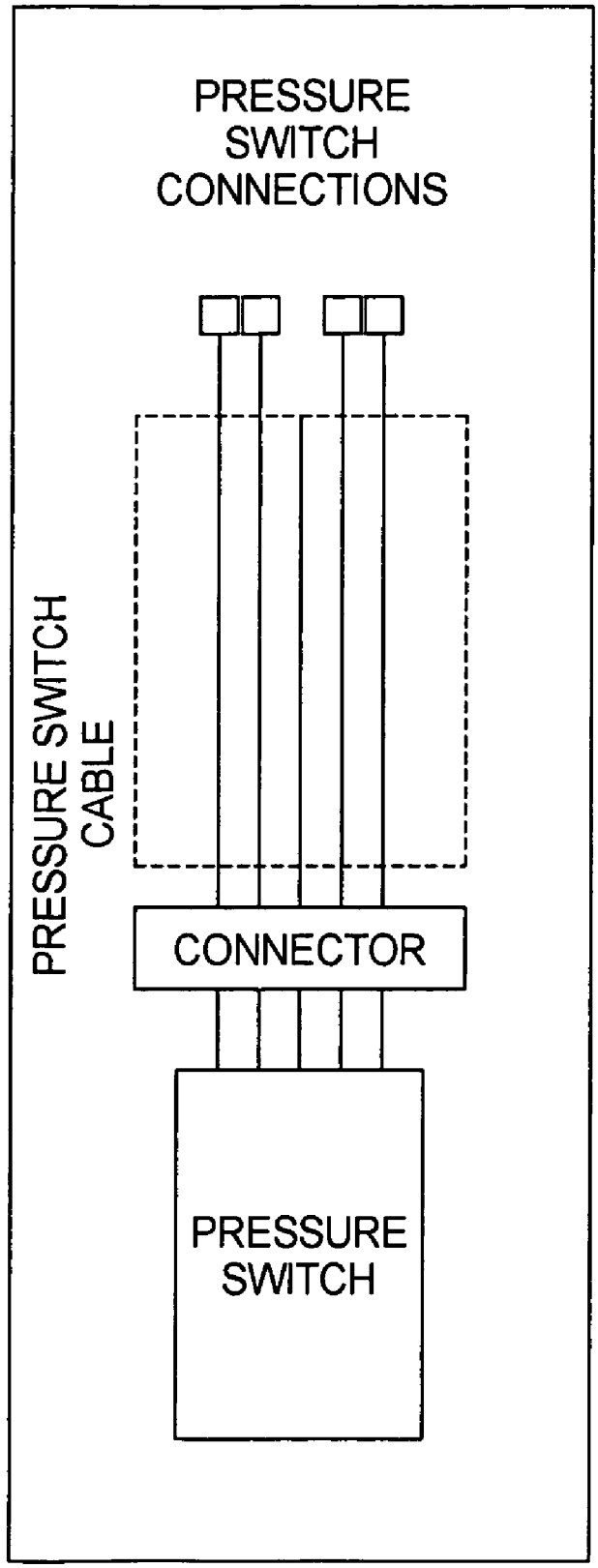

As noted, to control the opening and closing of valve 24 and the flow of 10 antifreeze solution to sprinkler piping system 12, system 10 includes control system 26. Control system 26 includes on the antifreeze side a control 40 (FIG. 6), such as a programmable logic controller (PLC), which is in communication with switches 30*a*, 54 and includes at least one solenoid valve 44 (for each sprinkler piping system, 44' for sprinkler piping system 12'). Control 40 is also in communication with and monitors pressure switch 32, which detects the pressure of the antifreeze solution in piping system 12, and monitors pressure switch 54, which measures the pump discharge pressure. Control 40 controls the opening and closing of solenoid valve 44 to control the flow of antifreeze solution to piping system 12. Solenoid valve 44 comprises a two-way solenoid valve, which is normally closed, and is only opened when control 40 detects a pressure drop in piping system 12 below a preset level, as detected by switch 32. Pressure switch 32 is located on the system side of check valve 22 or directly adjacent the system inlet, which monitors the antifreeze solution pressure and signals when the pressure is dropped below a preset value. When the pressure drops below a set point, control 40 opens solenoid valve 44 to allow the flow of antifreeze solution into system 12. When the preset pressure is achieved, the solenoid valve is shut off. Preferably, the antifreeze solution supply system control is in communication with air supervisory switches, which monitor the air pressure between the check valves and the control valves so that if a non-fire condition occurs but there is a pressure drop due to a sprinkler opening, the control will shut of the supply of antifreeze solution.

If a system is installed in a storage area that is subject to varying temperature changes, the system design should determine the maximum expansion and contraction rate of the antifreeze solution to establish if an additional supply tank is needed as a reserve tank. The reserve tank may be provided and used as a reclaim tank for the antifreeze solution in the sprinkler piping system when the system or systems are drained for system service and/or for discharge of the antifreeze solution if system pressure exceeds the desired maximum pressure at the sprinklers, for example 175 PSI (1 207 kPa), as noted above. In addition, to relieve system pressure due to pressure buildup but maintain the system pressure above the set point pressure of the check valve 22, system 10 may include an automatic pressure control system 38*a*. In a warm-up situation, temperature fluctuations of the freezer area cause the pressure to also fluctuate. If the pressure increases over the set point of pressure relieve valve 42, the automatic pressure control system, which is also configured to prevent the pressure relieve valve from operating, except for emergency situations where extended power loss may occur, will reduce the pressure accordingly.

For example, storage areas that are expected to fluctuate more than 10 degrees from nominal temperature will experience significant increased pressure in the system piping due to expansion of the antifreeze solution when the temperature rises in the storage area. In order to prevent the pressure relief valve on valve 22 from operating, automatic pressure control system 38*a* is provided and set to maintain pressure below the set point of the pressure relief valve on valve 22 and above the sprinkler piping system maintenance pressure. However, alarm pressure switch 45 will prevent the automatic pressure control system 38*a* from operating when the deluge valve has operated.

Prior to installation of system, maximum temperature changes are required to be considered to determine possible expansion and contraction rate of antifreeze solution. If the contraction rate is greater than tank 34, an additional supply tank to supplement excess pressure pump may be needed. Typically, pressure relief valves operate at 90-105% of design set pressure and close at 80% or greater than design set pressure. The pressure relief valve set pressure must be at least 125% of the maximum water supply pressure at inlet of the primary check valve though in order to not allow operation other than to protect the sprinklers of system at 175 PSI (12 bar). For freezers or coolers that fluctuate in temperature, the automatic pressure control system is preferred that allows antifreeze solution to be relieved back into tank 34 or a reserve tank. Calculation of volume fluctuation of the largest system where multiple systems are installed must be made in order to make sure the tank volume of antifreeze supply is large enough to contain the volume differential. For example, the automatic pressure control system set point may be at least 5 PSI (34,5 kPa) greater than the maximum static or residual supervisory pressure of the sprinkler piping system, with the pressure relief valve 43 then used as a safety backup to the pressure control system in case of power loss and non-presence of backup power system to the freezer temperature control system.

If the pressure should increase due to warm-up above the rated static pressure of the system, the pressure relief valve or automatic control system will bleed off antifreeze solution and maintain the maximum pressure of 175 PSI (1 207 kPa) or below at the sprinkler. It is recommended to fill the system with antifreeze after the freezer is at the sustained set temperature. Or, cool the antifreeze solution in the freezer area and then add it to the system. This will allow the piping system to establish a normal ambient temperature when filling the system with antifreeze. Slight warming will occur during the fill process. Another option is to fill the system while warm, and then monitor tank level and add more solution as needed as the temperature cools.

Figure 5:
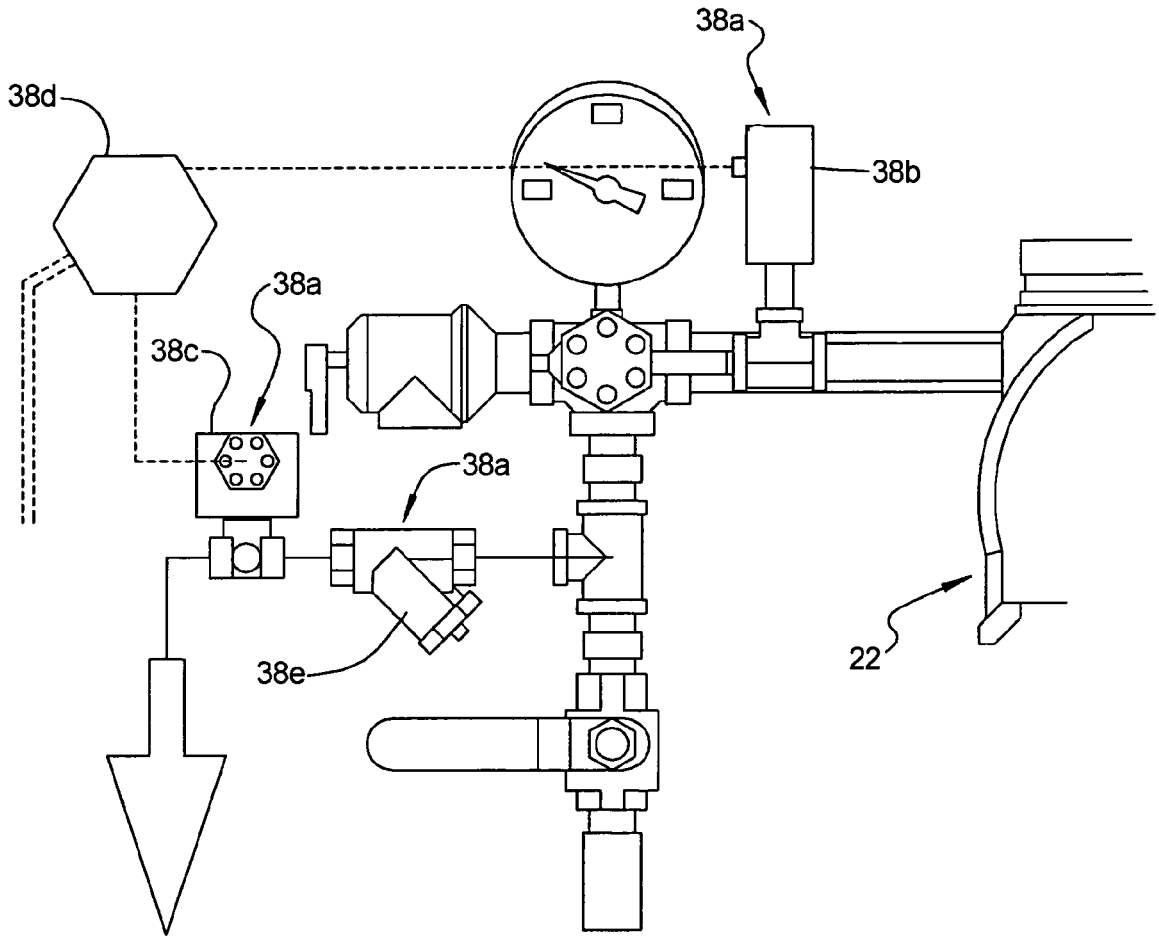
FIG. 5 is an enlarged schematic view of an automatic pressure control system of the fire protection system.

Referring to FIG. 5, automatic pressure control system 38*a* includes an electronic digital pressure switch 38*b*, which includes a normally open switch that is set to close at a pressure below the pressure relieve valve (43) set point and open above the shut off pressure of the sprinkler system control switch of the pump system, a normally closed solenoid valve 38*c*, which is provided on check valve 22, and a strainer 38e. A power supply 38*d*, such as a 115 volt AC, 50 or 60 Hz., 15 to 20 ampere GFI protected electrical power supply, is optionally provided directly to switch 38*b* and solenoid valve 38*c*. The power supply from the switch to the solenoid valve may be wired through a non-interrupted alarm pressure switch, which will prevent the automatic pressure control system valve from operating when the system trips. As the pressure switch closing set point is reached due to system pressure increase upon warm-up of the freezer area, the switch will directly open the solenoid valve and release antifreeze solution back to the tank or reserve tank. When the pressure reaches the lower setting, the switch will open, shutting off power to the solenoid valve and stopping flow of antifreeze. The automatic pressure control system, however, as noted will not operate when the deluge valve has operated.

Where multiple riser systems are used, the antifreeze solution system can be supplied to multiple risers from a single pump system and the pressure switch for each system can be controlled through the pump system control 40. When the pressure drops below set point for a given sprinkler piping system, the respective solenoid valve (44, 44') shall open to allow flow of antifreeze solution into the respective system that is low on pressure. When pressure is established, the respective solenoid valve will shut off.

Where multiple systems are supplied from a single pump and a single system operates due to water flow from open sprinkler, control 40 is signaled by the alarm or flow switch of the operating riser and shuts off the supply solenoid to that riser. The remaining systems maintain supervisory pressure. This prevents contamination of antifreeze solution with water during operation of a single system and eliminates air pockets that may contaminate antifreeze solution or cause pipe corrosion.

As previously noted, valve 22 comprises a check valve, which maintains the isolation between the water supply and the antifreeze solution while the pressure of the antifreeze solution is maintained. However, once a fire is detected and a sprinkler head is opened, the antifreeze solution will be discharged from the first sprinkler closest to the check valve 22, which results in a rapid pressure drop in the antifreeze solution and opens check valve 22 to allow the water supply to flow into the piping system. In order to limit the delivery of antifreeze solution to the piping system through antifreeze supply system 30 in the event of a fire condition, control 40 is in communication with water flow alarm switch 45, which is in communication with valve 24 at the alarm port and is actuated when a fire condition occurs due to the flow of water through the valve. When control 40 detects flow through valve 24, control 40 closes solenoid vale 44. Conduit 38 of antifreeze solution delivery system 30 also includes an isolation valve 46*a* to provide a manual shut-off and check valve 46*b* to prevent back flow of antifreeze solution or water into the antifreeze supply system 30.

In addition to valves 22 and 24, which facilitate maintenance of the system and isolation of the antifreeze solution during maintenance and testing, system 10 further includes a system isolation valve 50, which is preferably supervised and facilitates maintenance of the system and isolation of the antifreeze solution during maintenance and testing. The system 10 also includes a pressure release valve 43 (FIG. 4) on the antifreeze side of the valve 22, which is preset at a pressure, for example in a range of 165 psi to 185 psi and, optionally, at 175 psi, and which drains to the main drain line or tank. In this manner, this system can handle the over pressurization due to thermal differentials in the area of the antifreeze piping and system operation.

As previously noted, supervisory switch 42 by way of control 40 controls the opening of solenoid valve 44. However, in the case of flow due to a system trip, control 40 maintains the solenoid valve 44 closed regardless of the system pressure. In the case of a fire and flow is established from a sprinkler head assembly, alarm switch 45 sends a signal to control 40, which prevents solenoid valve 44 from opening.

As noted above, control 40 preferably comprises a PLC, which receives input from a number of sources, including switches 30*a*, 30*b* and, optionally, from level switch and alarm 60 of tank 34 and, further, from tank pressure switch 54 (FIG. 2). Outputs from control 40 include outputs to pump 36 and solenoid 44. As previously described, control 40 opens solenoid 44 when switch 30*b* indicates that the pressure in the antifreeze solution has dropped below the set point. When solenoid 44 is opened, control 40 energizes pump 36 to pump the antifreeze solution from tank 34 through antifreeze supply line or conduit 38 to second inlet 22*d* of valve 22. In addition, control 40 detects the pressure measured by pressure switch 54, which is installed in the pump discharge line, and operates the pump 36 between two set pressures. In addition, as noted above, control 40 is in communication with alarm switch 45 so that when alarm switch 45 detects flow from the water supply through valve 24, which occurs as a result as a sprinkler head opening, control 40 will close solenoid 44 to stop antifreeze from being delivered to sprinkler piping system 12.

As previously noted, system 10 may include multiple sprinkler piping systems, such as piping system 12'. In the illustrated embodiment, system 12' is connected to water supply 18 through check valves 20', 22' and control valve 24'. System 12' is connected to tank 34 through an antifreeze delivery line 38' with an isolation valve 46*a*', a check valve 46*b*', and solenoid valve 44' similar to system 12. Furthermore, solenoid 44' is similarly controlled by control 40, which is in communication with a supervisory switch 42' provided at valve 24'. In this manner, each piping system 12, 12' may be individually activated to minimize the amount of antifreeze solution that is discharged by the system.

As previously mentioned, system 30 may be used to control one or more than one sprinkler piping system. In the illustrated embodiment, system 30 is configured to control the two sprinkler piping systems, with each of the systems connected to system 30 through a normally closed solenoid valve 44, 44'. The pressure supervisory switch and flow alarm switch for each system are in communication with control 40. When the system pressure of each system reaches the system set point, the respective system's pressure supervisory switch opens and control 40 closes that solenoid valve associated with the respective system. Where a pressure drop is detected by the supervisory pressure switch of one of the systems, pump 36 is operated. Pressure switch 30*a*, which monitors the pressure in the antifreeze delivery line, controls the pump operation. When the pressure drops, the pump will be turned on until the pressure rises above the set level. As noted above, in the case of flow during a system trip, that system's flow alarm pressure switch opens and control 40 prevents that particular system's solenoid valve from opening, regardless of system pressure. Control 40 may provide for two modes of operation—a manual mode and an automatic mode. The manual mode allows a user to operate the pump by means of a switch (not shown) regardless of the electrical control status. On the other hand, automatic operation uses the unit pressure switch 54 to operate the pump based on unit pressure. The flow to each system is controlled by that supply system's pressure switch and flow alarm switch (45, 45'). Optionally, a sight glass is mounted to storage tank 34, which allows visual indication of the antifreeze level.

In order to increase the system responsiveness, the system size can be limited in volume. Full-scale fire testing of a 50% propylene glycol and water premix solution and a system volume of 1,100 gallons (4 163 liters) has been performed successfully at Underwriters Laboratories Inc., resulting in UL Listing of the ESFR VK510 Sprinkler for use with 35% or 50% propylene glycol and water solution. The system uses either a 35% or 50% (depending on the minimum temperature in the area being protected) by volume mixture of propylene glycol and water premix solution.

The area of coverage for a single system is dependent upon the volume of the system required to cover the area being protected. The hydraulic calculations are necessary in order to properly size the system piping. Two sets of hydraulic calculations are used for the system piping; one utilizing Hazen-Williams method of determining friction loss, and one utilizing Darcy-Weisbach method of determining friction loss. The Hazen-Williams friction loss factors will be utilized for flowing water through the piping, the Darcy-Weisbach friction loss factors will be utilized for flowing propylene glycol/water solution through the system piping at the lowest operating temperature. As would be understood, upon operation of the detection system the deluge valve opens prior to sprinkler operation and pressurizes the sprinkler piping to the desired discharge pressure. Upon operation of the sprinkler (s), the pressurized antifreeze solution is distributed from the sprinkler. Water from the supply system pushes out the antifreeze solution at a very rapid rate due to the sprinkler orifice size and design pressures. The limited system volume ensures that close to 100% water will flow from the sprinklers at an appropriate stage of fire development.

In the event of a broken sprinkler or sprinkler pipe without a fire condition, the deluge valve will hold back the water supply and only antifreeze will be drained from the sprinkler or broken pipe. This will prevent large amounts of water from being discharged and possible contamination of the antifreeze left in the system that could cause undesired freezing in the piping. A pressure supervisory switch on the antifreeze system located at valve 22 adjacent to the valve 24 will provide an alarm of low-pressure condition. The antifreeze supply from the pump must be manually shut off in this condition at the riser supply point.

When using this system, only ceiling sprinklers are needno in-rack sprinklers are needed. When applied to storage applications, the system is best suited for single-row, double-row, and multiple-row rack storage, with the sprinklers located in accordance with applicable Viking technical data and the latest recognized storage installation rules of NFPA or the Authority Having Jurisdiction (AHJ) or open rack storage, with the sprinklers located in accordance with applicable Viking technical data and the latest recognized storage installation rules of NFPA or the Authority Having Jurisdiction (AHJ). Further, in solid-piled or open rack (single, double, multiple, or portable), palletized storage (pallets limited to wood), there should be no open-top containers or solid shelves. Further, the commodity should be limited to Class II or less. Further, the present invention is at least suitable for storage heights up to 35 ft. (10,7 m) with ceiling heights up to 40 ft. (12,2 m) and with a minimum system design pressure of 40 PSI (278 kPa) or storage height up to 40 ft. (12,2 m) with ceiling height up to 45 ft-3 in. (13,8 m) with a minimum system design pressure of 60 PSI (414 kPa).

Further, when installing the system it is preferable that the deluge valve 24 and trim system, system check valves 20 and 22 along with all supply piping (antifreeze solution supply and water supply) are installed in a heated area that is maintained at or above 40° F. (4° C.). Insulating the fire sprinkler riser is typically preferable to eliminate condensation and frost from developing on the piping in the heated area. For example, insulation may be applied to the riser from the freezer wall to the isolation check valve. However, where the second downstream check valve is employed, the insulation may be reduced, if not eliminated. If the primary system check valve is close enough to the isolation check valve (20), for example less than the 5 ft (1.5 m), and to the freezer separation wall to cause freezing of water and condensation on piping below check valve 20, then a heat trace heating system may be required for the riser piping above and below the primary check valve that will maintain a temperature under the insulation of 70° F. (21.1° C.) to eliminate condensation and maintain internal temperature of solution above freezing for air below the primary check valve.

The use of antifreeze solution, applied using the preaction fire protection system of the present invention, makes possible single or double interlock protection to prevent costly water flow when no fire is present. This combines supervision of the piping system and the detection system for operation of water supply only when a fire occurs. The further combination of antifreeze solution and air supervision of the piping system also allows for a FAILSAFE preaction system application. In case of a power outage for an extended period of time, the system can revert to a dry system in combination with the wet antifreeze supervision. Rapid detection systems combined with the preaction deluge sprinkler system also allow for rapid fill of the piping system and the system to operate as a pre-charged system. The heat detection system may be fixed temperature or rate of rise, electric or pneumatic controlled. For electric controlled systems, a releasing control panel connected to the control solenoid valves of the preaction valve system is preferred. With an air supervised system piping, upright or dry pendent sprinklers may be used to prevent freezing when system is drained down.

While several forms of the invention have been shown and described, other forms will now be apparent to those skilled in the art. As would be understood, the present invention provides an early suppression fast response sprinkler (ESFR) technology that can now be applied using preaction fire protection technology that causes less damage due to water discharge. A single sprinkler piping system or multiple sprinkler piping systems can be applied using the fire suppression solution as a system supervisory system. With the controllable preaction system, multiple areas of system supervision are capable, which allows more rapid transit of water to sprinkler and less damage to complete system in case of fire or water entering the system piping. The combination of a detection system and sprinklers allow for better control of water supply operation, which will prevent unwanted water flow when not required. With allowance of smaller system coverage, using preaction technology quicker flow of water to sprinkler is capable, as required by ESFR protection, and when fire water is required only the effected area of fire is affected by water contamination of piping system and potentially can freeze. In a cold environment application, this can prevent undesired freezing of the sprinkler piping system.

Further, in existing wet-systems, where the antifreeze solution is isolated from the water supply only by a primary check valve any one or more of the features described herein may be combined with the wet-system to provide an improved system. For example, the wet-system may incorporate the automatic pressure control system of the present invention to better control the opening of the check valve, and/or the second check valve to reduce the frost on the primary check valve, and/or the automatic vents may be used to allow the gas in the system to be bled upon filling the sprinkler system with antifreeze solution. Further, any one of the features described herein may be combined with the systems described in the parent application of this application, which is hereby incorporated in its entirety herein.

Therefore, it will be understood that the embodiments shown in the drawings and described above are merely for illustrative purposes, and are not intended to limit the scope of the invention, which is defined by the claims, which follow as interpreted under the principles of patent law including the doctrine of equivalents.

I claim:

1. An early suppression fast response fire protection system comprising:

sprinkler piping system including at least one sprinkler head assembly and at least one automatic vent venting gas in said sprinkler system piping when said sprinkler system piping is filled with fire suppression solution;

a water supply system; a check valve having a water supply inlet and an outlet, said outlet of said check valve in fluid communication with said sprinkler piping system and said water supply inlet in selective fluid communication with said water supply system;

a fire suppression solution supply system in fluid communication with said sprinkler piping system, said check valve isolating said fire suppression solution from said water supply unless a fire condition occurs;

a pressure detector detecting the pressure of the fire suppression solution in said sprinkler piping system; a flow detector detecting the flow of water from said water supply system; and a control system in communication with said flow detector and said pressure detector, said control system controlling the flow of said fire suppression solution to said sprinkler piping system and maintaining the pressure of said fire suppression solution in said sprinkler piping system unless said flow detector detects the flow of water from the water supply system in which case said control system stops the flow of said fire suppression solution to said sprinkler piping system to limit the discharge of fire suppression solution from the fire protection system.

2. An early suppression fast response fire protection system according to claim 1, wherein said sprinkler piping system further is adapted to limit thermal transfer from said fire suppression solution to said check valve.

3. An early suppression fast response fire protection system according to claim 1, wherein said sprinkler piping system includes a plurality of automatic vents.

4. An early suppression fast response fire protection system according to claim 1, wherein said sprinkler piping system comprises a tree-shaped piping system with a main pipe and a plurality of branch pipes off said main pipe.

5. An early suppression fast response fire protection system according to claim 4, wherein each of said branch pipes includes an automatic vent.

6. An early suppression fast response fire protection system according to claim 1, wherein said check valve comprises a primary check valve, said fire protection system further comprising a second check valve between said primary check valve and said sprinkler piping system, said second check valve reducing thermal transfer from the cold antifreeze solution in the storage area to said primary check valve.

7. An early suppression fast response fire protection system according to claim 1, further comprising a control valve between said check valve and said water supply system, said control valve in fluid communication with said inlet of said check valve and in fluid communication with said water supply system, said check valve and said control valve isolating the antifreeze solution from said water supply system until a fire is detected.

8. An early suppression fast response fire protection system according to claim 7, wherein said control valve includes an inlet and an outlet, said outlet of said control valve in fluid communication with said inlet of said check valve through a conduit, and said conduit being filled with air.

9. An early suppression fast response fire protection system according to claim 8, wherein said control system includes an air pressure monitoring system monitoring the air pressure in said conduit.

10. An early suppression fast response fire protection system according to claim 9, further comprising at least one fire detector, said control system in communication with said fire detector, said air pressure monitoring system, and said control valve, said control system actuating said control valve to open in response to said detector detecting a fire condition.

11. An early suppression fast response fire protection system according to claim 1, further comprising an automatic pressure control system, said automatic pressure control system automatically relieving pressure in said sprinkler piping system when the pressure of the antifreeze solution in said sprinkler piping system exceeds a maximum pressure valve but maintains said pressure at a minimum pressure.

12. An early suppression fast response fire protection system according to claim 1, further comprising:

a second sprinkler piping system with at least one sprinkler head assembly;

a second check valve having a water supply inlet and an outlet, said outlet of said second check valve in fluid communication with said second sprinkler piping system, and said water supply inlet of said second check valve in fluid communication with said water supply system;

said antifreeze solution supply system in fluid communication with said second sprinkler piping system, said second check valve isolating said antifreeze solution in the second sprinkler piping system from said water supply unless a fire condition occurs;

a second pressure detector detecting the pressure of the antifreeze solution in said second sprinkler piping system; a second flow detector detecting the flow of water through said second check valve from said inlet to said outlet of said second check valve when said second check valve is opened; and said control system in communication with said second flow detector and said second pressure detector, said control system controlling the flow of antifreeze system to said second sprinkler piping and maintaining the pressure of said antifreeze solution in said second sprinkler piping system unless said second flow detector detects the flow of water through said second check valve from said inlet to said outlet of said second check valve in which case said control system stops the flow of antifreeze solution to said second sprinkler piping system to limit the discharge of antifreeze solution from the fire protection system.

13. An early suppression fast response fire protection system according to claim 12, wherein each of said sprinkler piping systems comprises a tree-shaped configuration with a main line and a plurality of branch lines extending from said main line.

14. An early suppression fast response fire protection system according to claim 13, wherein said sprinkler head assemblies each have a K-factor in a range of 11 to 50.

15. An early suppression fast response fire protection system according to claim 13, wherein each of said sprinkler head assemblies comprises a pendent or upright sprinkler.

16. An early suppression fast response fire protection system comprising:

a plurality of sprinkler piping systems, and each sprinkler piping system having at least one sprinkler head assembly;

a water supply system;

a check valve for each sprinkler piping system, each check valve having an inlet and an outlet, each of said outlets of said check valves in fluid communication with a respective sprinkler piping system of said sprinkler piping systems, and each of said inlets in fluid communication with said water supply system;

an antifreeze solution supply system in fluid communication with each of said sprinkler piping systems, each of said check valves isolating said antifreeze solution in said respective sprinkler piping system from said water supply unless a fire condition occurs; pressure detectors detecting the pressure of the antifreeze solution in each of said sprinkler piping systems;

a flow detector associated with each of said sprinkler piping systems, said flow detectors detecting the flow of water from said water supply to each of said sprinkler piping systems;

a controller in communication with said flow detectors and said pressure detectors, said controller controlling the flow of antifreeze solution to each of said sprinkler piping systems and maintaining the pressure of said antifreeze solution in each of said sprinkler piping systems unless a flow detector associated with a respective sprinkler piping system detects the flow of water from said water supply system to said respective sprinkler piping system in which case said controller stops the flow of antifreeze solution to said respective sprinkler piping system to limit discharge of antifreeze solution from the fire protection system; and an automatic pressure control system for each of said sprinkler piping systems, said automatic pressure control system automatically relieving pressure in a respective sprinkler piping system when the pressure of the fire suppression solution in said respective sprinkler piping system exceeds a maximum pressure.

17. An early suppression fast response fire protection system according to claim 16, further comprising a control valve for each sprinkler piping system, said control valves each in fluid communication with said water supply system and in fluid communication with said check valve of a respective sprinkler piping system.

18. An early suppression fast response fire protection system according to claim 17, further comprising at least one fire detector associated with each of said sprinkler piping systems, said control valves controlling the flow of water from said water supply to said check valves, said controller opening said control valve to open the flow from the water supply to said check valve of a respective sprinkler piping system associated with a fire detector which detects a fire.

19. An early suppression fast response fire protection system according to claim 18, wherein said control valve comprises a preaction deluge valve.

20. An early suppression fast response fire protection system according to claim 16, wherein each of said sprinkler piping system comprises a tree-shaped configuration with a main line and a plurality of branch pipes extending from said main line.

21. An early suppression fast response fire protection system according to claim 20, wherein at least one branch pipe of each sprinkler piping system includes a vent to vent gas from its respective sprinkler piping system.

22. An early suppression fast response fire protection system according to claim 21, wherein said vents comprise automatic vents.

23. An early suppression fast response fire protection system according to claim 16, wherein said fire suppression solution comprises an antifreeze solution and said check valves comprise primary check valves, further comprising a second check valve for each sprinkler piping system, said second check valves reducing thermal transfer from the antifreeze solution to said primary check valves.

24. An early suppression fast response fire protection system according to claim 16, wherein said controller is in communication with said automatic pressure control system.

25. A cold storage fire suppression system comprising:

a sprinkler piping system having at least one sprinkler head assembly;

a water supply system;

a primary check valve having an inlet and an outlet in fluid communication with said sprinkler piping system;

a deluge valve in selective fluid communication with said inlet of said check valve, and said deluge valve for controlling flow of water to said sprinkler piping system from said water supply system;

at least one fire detector associated with said sprinkler piping system for detecting a fire condition;

an antifreeze solution supply system in fluid communication with said sprinkler piping system, said check valve isolating said antifreeze solution from said water supply system unless a fire condition occurs and said deluge valve is opened;

a second check valve, said second check valve reducing the thermal transfer from the antifreeze solution in said sprinkler system piping to said primary check valve;

a pressure detector detecting the pressure of the antifreeze solution in said sprinkler piping system;

a control system monitoring said pressure detector, and said control system supplying said antifreeze solution to said sprinkler piping system and maintaining the pressure of said antifreeze solution in said sprinkler piping system; and said control system in communication with said fire detector and said deluge valve, said control system actuating said deluge valve to open in response to said fire detector detecting a fire condition, and said control system stopping the flow of antifreeze solution to said sprinkler piping system to limit the discharge of antifreeze solution from the fire protection system when said control system detects flow of water through said deluge valve.

26. A cold storage fire suppression system according to claim 25, wherein said second check valve is located at least five (5) feet downstream of said primary valve.

27. A cold storage fire suppression system according to claim 25, wherein said sprinkler piping system includes a tree-shaped configuration with a main pipe and a plurality of branch pipes extending from said main pipe, each of said branch pipes having a plurality of sprinkler head assemblies and, further, a vent to vent said sprinkler piping system when being filled with said antifreeze solution.

28. A cold storage fire suppression system according to claim 27, wherein said control system further includes an automatic pressure control system, said automatic pressure control system releasing the pressure of said antifreeze solution in said sprinkler piping system when said pressure exceeds the maximum pressure of said sprinkler piping system but maintains said pressure at a minimum pressure.

* * * * *

UNITED STATES PATENT AND TRADEMARK OFFICE

CERTIFICATE OF CORRECTION

PATENT NO. : 7,389,824 B2
APPLICATION NO. : 11/387607
DATED : June 24, 2008
INVENTOR(S) : Eldon D. Jackson It is certified that error appears in the above-identified patent and that said Letters Patent is hereby corrected as shown below:

At col. 2, line 6, delete “holds” and insert --hold-- therefor.

At col. 3, line 17, delete “is” and insert --in-- therefor.

At col. 11, line 61, delete “10.”.

At col. 12, line 22, delete “of” and insert --off-- thereof.

At col. 14, line 16, delete “vale” and insert --valve-- thereof.

At col. 16, line 9, delete “need—” and insert --needed;-- therefor.

Signed and Sealed this

Twenty-eighth Day of October, 2008

JON W. DUDAS
*Director of the United States Patent and Trademark Office*